US008595962B2

(12) United States Patent
Glass et al.

(10) Patent No.: US 8,595,962 B2
(45) Date of Patent: Dec. 3, 2013

(54) PULL TAB GIFT CARD HOLDER

(71) Applicant: Gift Card Impressions, LLC, Overland Park, KS (US)

(72) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/753,309

(22) Filed: Jan. 29, 2013

(65) Prior Publication Data

US 2013/0199964 A1 Aug. 8, 2013

Related U.S. Application Data

(63) Continuation-in-part of application No. 13/295,068, filed on Nov. 12, 2011, now abandoned.

(51) Int. Cl.
*G09F 1/00* (2006.01)

(52) U.S. Cl.
USPC ..... 40/124.06; 40/488

(58) Field of Classification Search
USPC ..... 40/124.01, 124.06, 124.08, 610, 445, 40/800, 739, 740; 446/147, 149, 144, 151, 446/152; 229/92.8; 434/405, 348, 427; 206/232
See application file for complete search history.

(56) References Cited

U.S. PATENT DOCUMENTS

| | | | | |
|---|---|---|---|---|
| 1,499,891 | A * | 7/1924 | Storer | 40/124.08 |
| 2,727,622 | A | 12/1955 | Neumann | |
| 3,834,051 | A | 9/1974 | Barnes, Jr. et al. | |
| 5,038,930 | A | 8/1991 | Holtkamp, Jr. | |
| 5,096,751 | A * | 3/1992 | Duchek | 428/12 |
| 5,575,384 | A | 11/1996 | Saye | |
| 5,580,098 | A * | 12/1996 | Gates | 281/38 |
| 5,586,659 | A | 12/1996 | Trumbo | |
| 5,884,770 | A | 3/1999 | Galm | |
| 6,811,025 | B1 | 11/2004 | Kaplan | |
| 7,356,953 | B2 | 4/2008 | Davis | |
| 2007/0293118 | A1 | 12/2007 | Prescott | |

FOREIGN PATENT DOCUMENTS

FR 2812558 2/2002

OTHER PUBLICATIONS

Americhip, "Bloomingdale's 3D Stage", from Americhip.com/cgi-bin/...proddisp.pl?c . . . , web page printed May 19, 2011, Americhip, Los Angeles, California, USA, copyright 2011.
Blogspot.com, Elizabeth's Craft Room, "Shadow Box Christmas Card", from ...blogspot.com/.../shadow-box-christ . . . , web pp. 1-8, printed May 19, 2011.
The Sunset House, "Shadow Box Card Tutorial", from Thesunsethouse.com web pages entitled Papercrafts, Photography, and Recipes for Life, pp. 1-7, printed May 19, 2011.

* cited by examiner

*Primary Examiner* — Joanne Silbermann
(74) *Attorney, Agent, or Firm* — Polsinelli PC

(57) ABSTRACT

An expanding card holder includes pleated flaps operated by manipulating opposing pull tabs to selectively reveal hidden images, decorations, characters or text within the holder.

2 Claims, 8 Drawing Sheets

100
205
135
115
195
110
155
155
B
A
B
Y
120
a Little Ray of Sunshine
150
151
151
150

100
151
205
110
140
115
151
120
155
155
Enjoy your
new bundle!
140
135

PULL TAB GIFT CARD HOLDER

CROSS REFERENCE TO RELATED APPLICATIONS

This application is a continuation in part of co-pending application Ser. No. 13/295,068, filed Nov. 12, 2011, incorporated by reference herein, and also claims therefrom the benefit of the prior filed provisional application Ser. No. 61/413,186, filed Nov. 12, 2010.

BACKGROUND OF THE INVENTION

This invention relates generally to gift card holders and more particularly to a device for holding a gift card or gift card packet while providing graphical and mechanical enhancements to entertain the gift card recipient and add value to the gift, namely a gift card holder that provides means for a user to selectively reveal hidden images, decorations, characters or text by manipulating moveable holder components.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift.

BRIEF DESCRIPTION OF THE INVENTION

The purpose of this invention is to provide a holder for receiving and holding a gift card. The gift card holder provides graphical and mechanical enhancements to entertain the gift card recipient and add value to the gift. The gift card holder may comprise a backer board supporting a bellowed frame comprising a front panel surrounding an aperture or window and pleated sides extending from the front panel to attach to the front surface of the back board. The frame may therefore extend from or retract closer to the backer board as the pleated sides unfold or fold, respectively. The space between the frame and the backer board mimics a stage in which one or more images are displayed upon the front surface of the backer board and/or upon cardstock cutout character or decorative elements that may be mounted within the space and which are viewable through the window. When the frame is in a retracted disposition, the window is closed by two pleated flaps that may be designed to mimic stage curtains. Pull tabs extend from the outer margins of the flaps and through apertures in the side walls so that they may be grasped by a user. Each flap typically comprises three panels serially connected to one another by two folds or hinges, namely an outer panel, middle panel and rear panel. The flaps may share a common rear panel, which is typically adhered to the backer board and may form a partial front covering of the backer board that displays the backer board images referenced above. The pull tabs extend outwardly from each outer panel.

One or more character or decorative elements, typically shapes cut from cardstock, project from or are mounted upon an elongated base that extends outwardly in the plane of the backer board and frame toward the sides. Base ends pass through apertures in the middle panels and are terminated in lateral extensions that exceed the aperture dimensions and, therefore, form stops so prevent the base ends from sliding out of the apertures.

The backer board includes a pocket therein that opens at the top margin of the backer board. A thumb notch may be provided to assist with removal of the gift card from the pocket.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
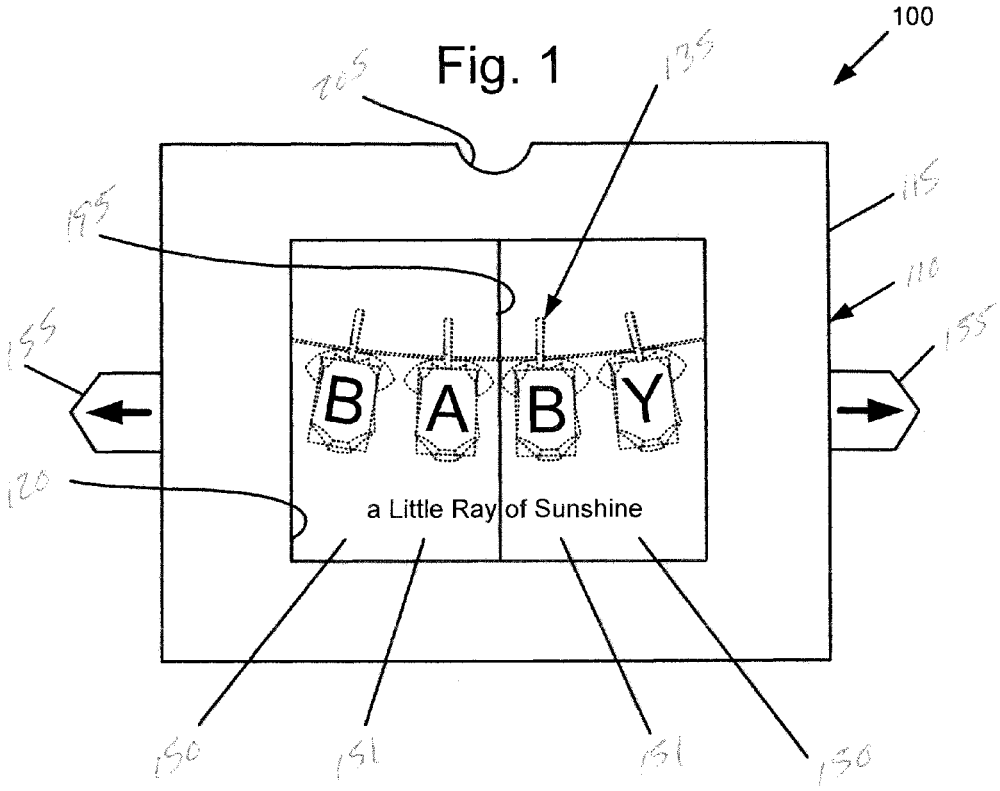
FIG. 1 is a front view of an embodiment of a gift card holder showing the flaps in a closed position.
Figure 2:
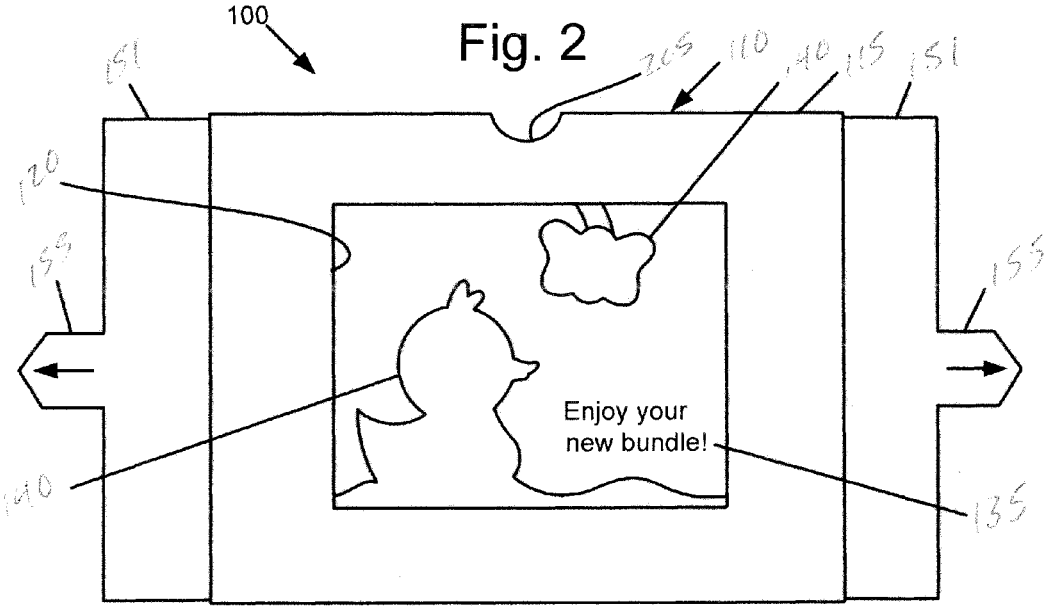
FIG. 2 is a front view of a gift card holder showing the flaps in an open position to reveal images including characters, decorative elements and text behind the frame of the front panel.
Figure 3:
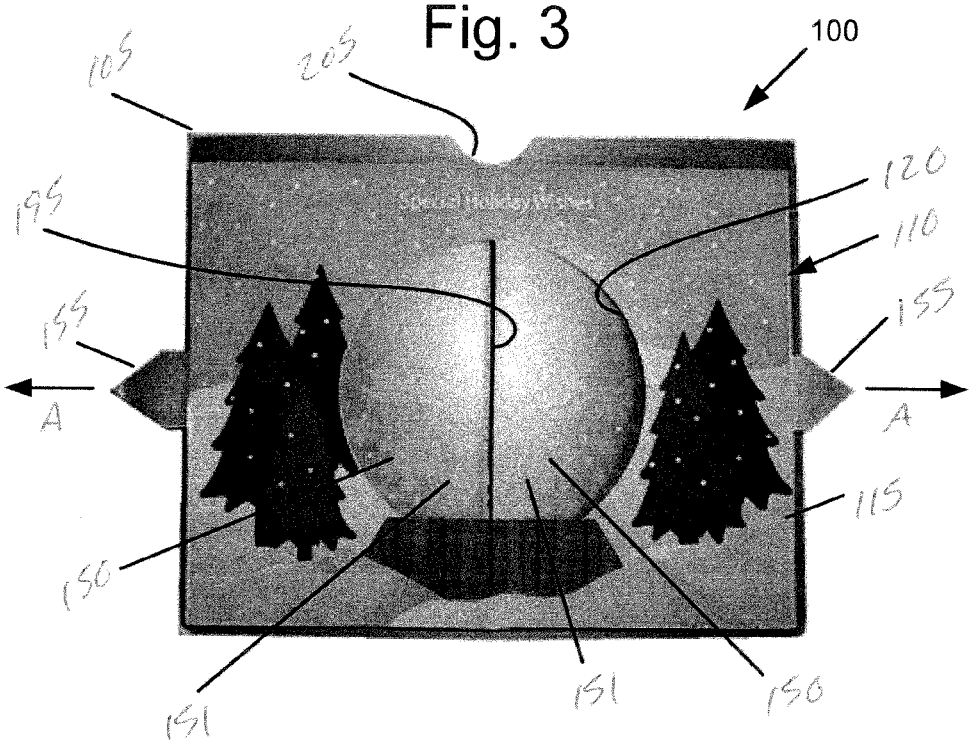
FIG. 3 is a front view of an embodiment of a gift card holder showing the flaps in a closed position.
Figure 12:
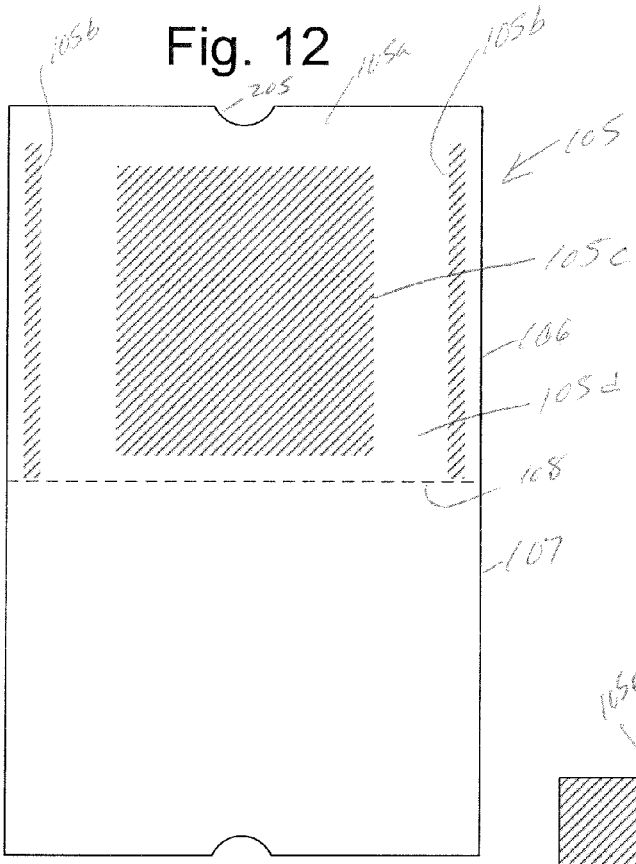
FIG. 12 is a front plan view of an unassembled backer board.

With reference to the figures, FIGS. 1 through 17 illustrate embodiments of a gift card holder 100 comprising a backer board 105 supporting a bellowed frame 110. The frame 110 comprises a front panel 115 surrounding an aperture or window 120 and pleated sides 125 extending from the front panel 115 to attach to the front surface 105*a* of the backer board 105. Tabs 125*a* extending from the sides 125 contact and are attached to the front surface 105*a*. FIG. 12 shows adhesive 105*b* applied to the front surface 105*a* that contacts the tabs 125*a* at tab attachment locations indicated by phantom lines 125*b* on the reverse side (from that shown) of the tabs 125*a*. The frame 110 may therefore extend from or retract closer to the backer board 105 as the pleated sides 125 unfold or fold, respectively. The space 130 between the frame 110 and the backer board 105 mimics a stage in which one or more images or text 135 are displayed upon the front surface of the backer board 105 (or rear panel 153 adhered thereto) and/or upon cardstock cutout character or decorative elements 140 that may be mounted within the space and which are viewable through the window 120. When the frame 110 is in a retracted disposition, the window 120 is closed by two pleated flaps 150 that may be designed to mimic stage curtains. FIGS. 1 and 3 are front views of embodiments of a gift card holder 100 showing the flaps 150 in a closed position.

Pull tabs 155 extend from the outer margins of the flaps 150 and through apertures 160 in the sides 125 so that they may be grasped by a user. Each flap 150 typically comprises three panels serially connected to one another by two folds or hinges, namely an outer panel 151, middle panel 152 and rear panel 153. The flaps 150 may share a common rear panel 153 (see FIGS. 7, 8 and 11), which is typically adhered to the backer board 105 and may form a partial front covering of the backer board 105 that displays the backer board images 135 referenced above. The pull tabs 155 extend outwardly from each outer panel 151.

One or more character or decorative elements (140 in FIGS. 2, 14, and 15 and 170 in FIGS. 5, 6, 7, and 8), typically shapes cut from cardstock, project from or are mounted upon an elongated base 175 that extends outwardly in the plane of the backer board 105 and frame 110 toward the sides 125. Base ends 180 pass through apertures 185 in the middle panels 152 and are terminated in lateral extensions 190 that exceed the aperture dimensions and, therefore, form stops 190 to prevent the base ends 180 from sliding out of the apertures 185.

Figure 4:
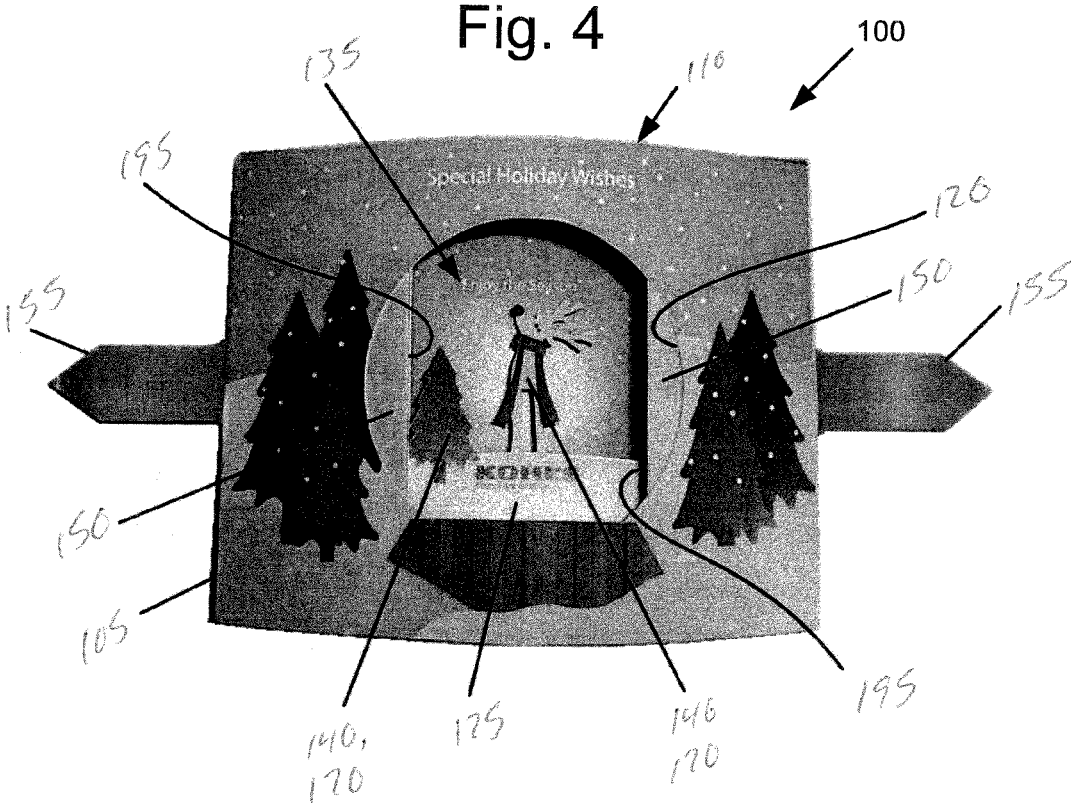
FIG. 4 is a front view of a gift card holder showing the flaps in an open position to reveal images including characters, decorative elements and text behind the frame of the front panel.
Figure 5:
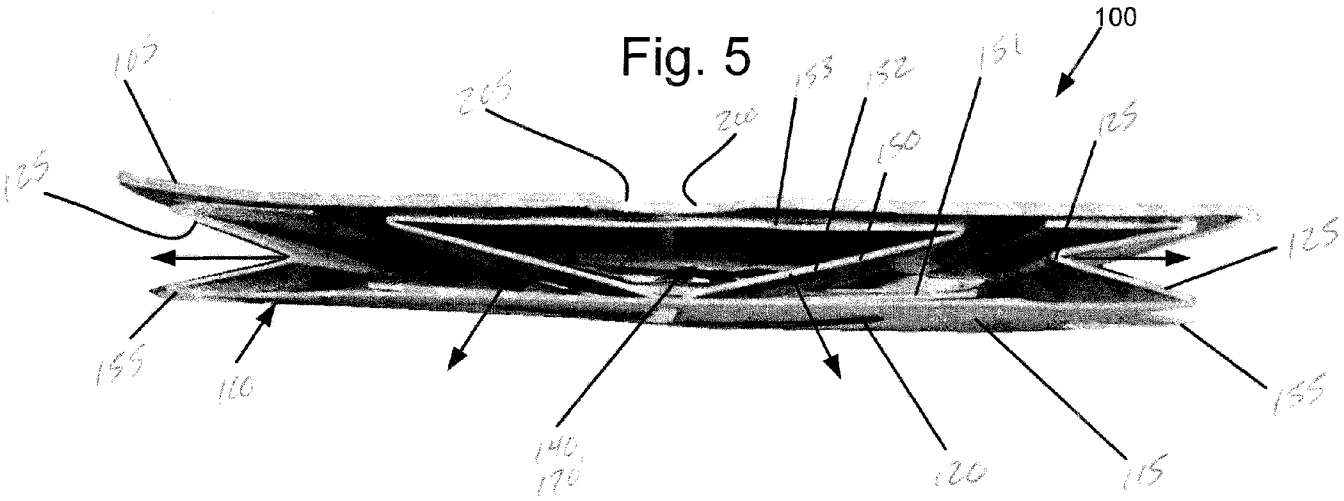
FIG. 5 is a top view of a gift card holder showing the flaps in a closed position and the front panel substantially retracted proximate to the backer board.
Figure 6:
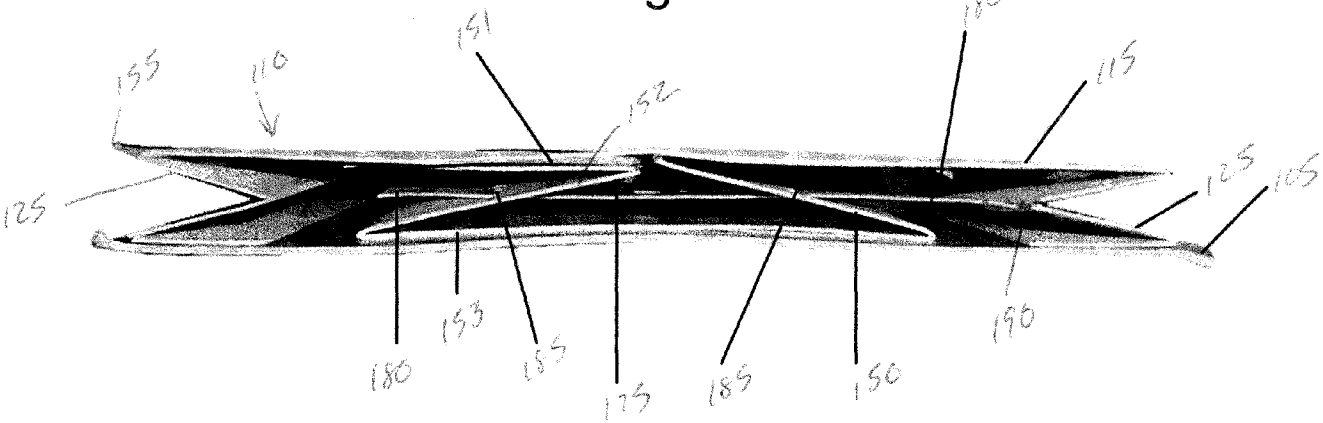
FIG. 6 is a bottom view of a gift card holder showing the flaps in a closed position and the front panel substantially retracted proximate to the backer board.
Figure 7:
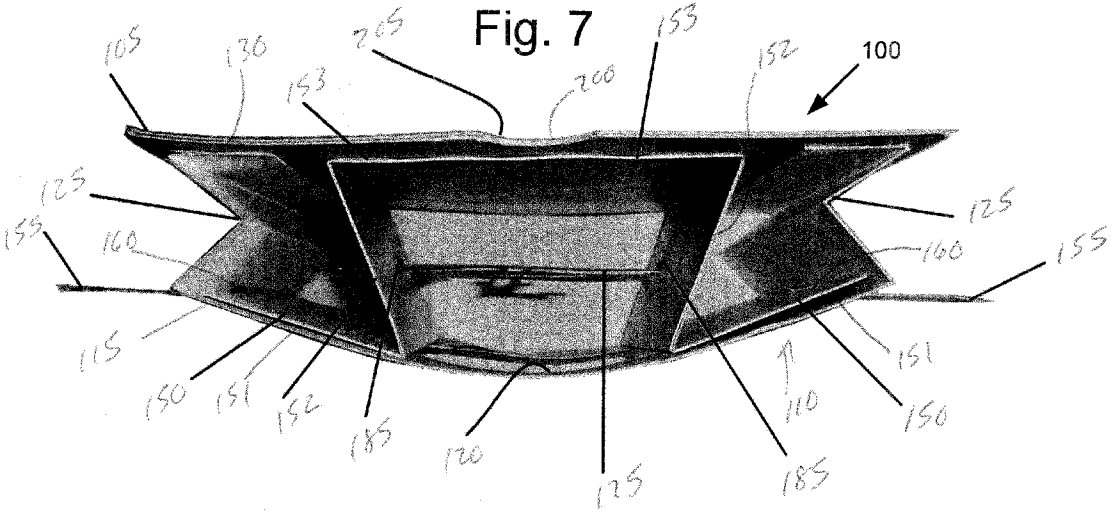
FIG. 7 is a top view of a gift card holder showing the flaps in an open position and the front panel extended away from the backer board by outward pressure exerted by the flaps.
Figure 8:
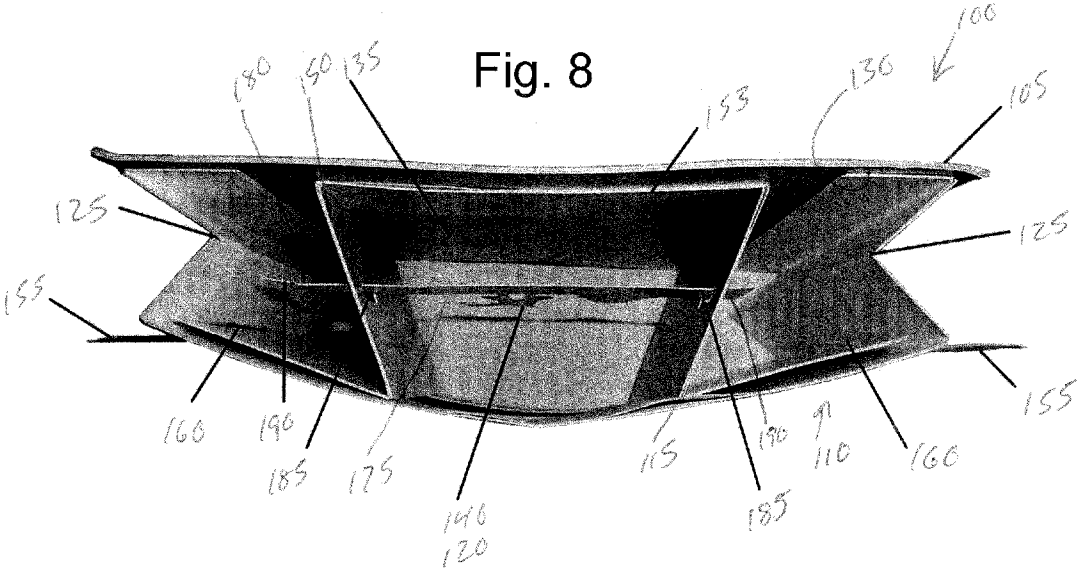
FIG. 8 is a bottom view of a gift card holder showing the flaps in an open position and the front panel extended away from the backer board by outward pressure exerted by the flaps.
Figure 9:
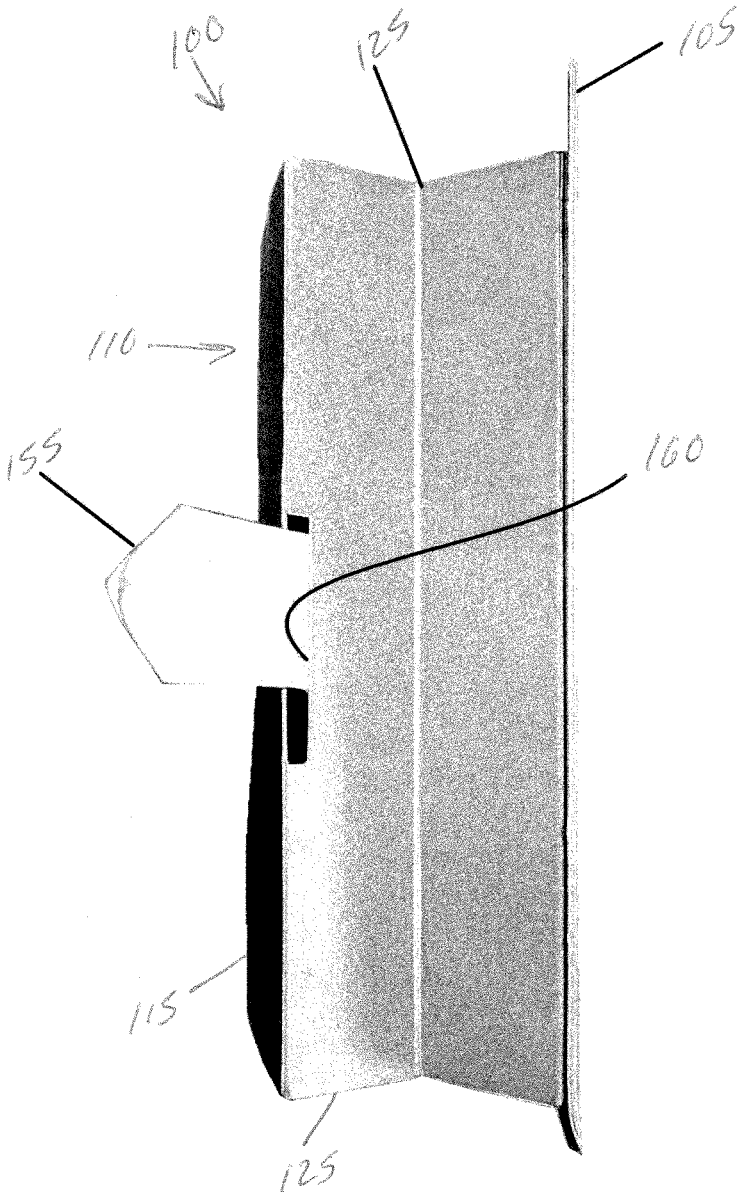
FIG. 9 is a right side view of a gift card holder in an open position showing the front panel extended away from the backer board.
Figure 10:
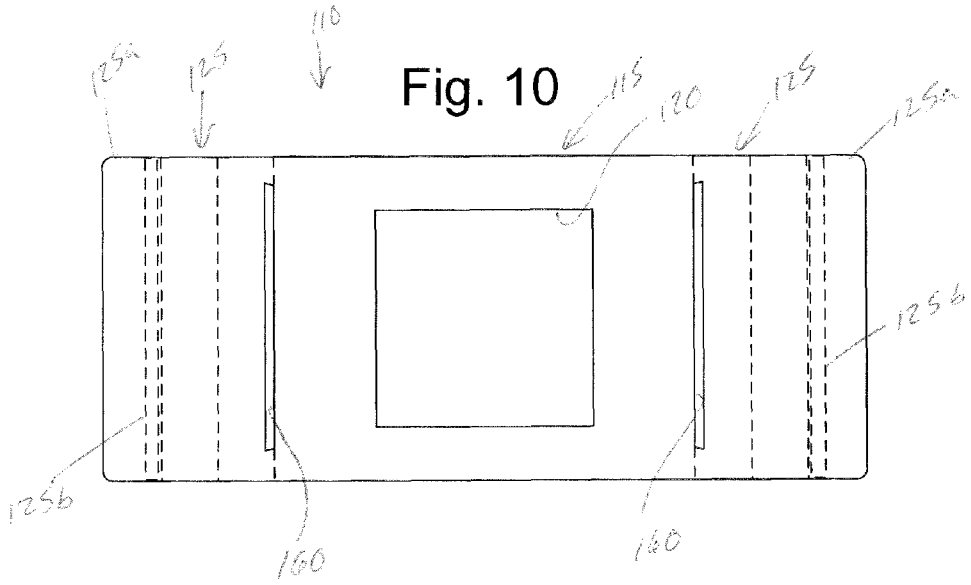
FIG. 10 is a front plan view of a frame.
Figure 11:
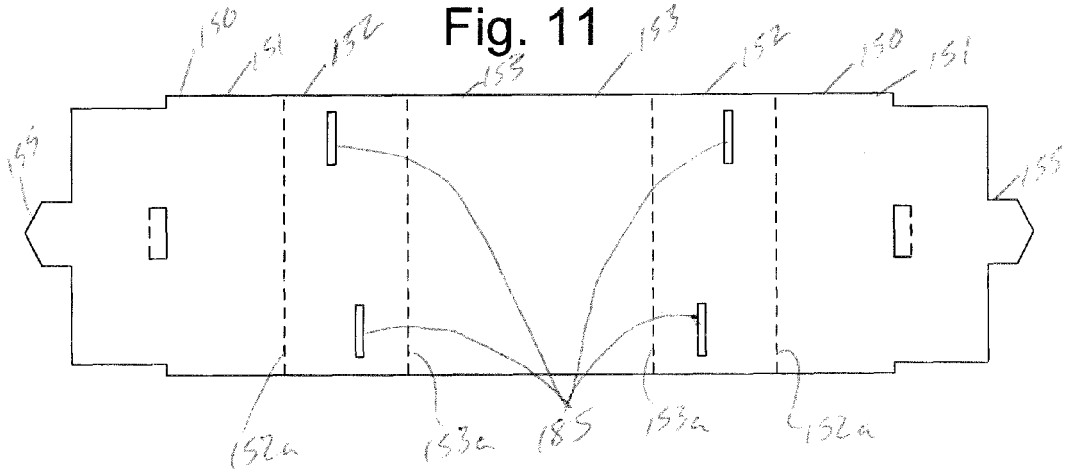
FIG. 11 is a front plan view of the pull tabs, flaps and associated panels.

When the pull tabs 155 are pulled outward in the direction of arrows A (see FIG. 3), the middle 152 and outer 151 panels move about the hinge or fold lines therebetween (152*a* and 153*a*) and the front edge of middle panel 152 moves forward to exert pressure on the outer panel 151, which transmits such pressure to the frame 110 causing the front panel 115 to extend forward, and the outer panels 151 move outward opening a space 195 therebetween and revealing the images 135 and elements 140, 170 behind the window 120. FIGS. 2 and 4 each provide a front view of a gift card holder 100 showing the flaps 150 in an open position to reveal images including characters, decorative elements and text behind the frame 110.

Figure 13:
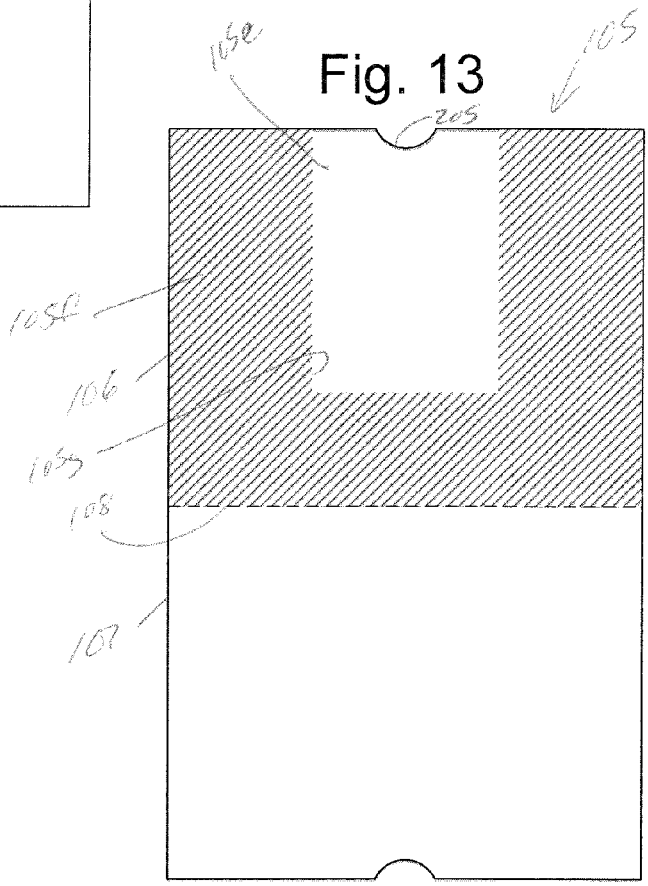
FIG. 13 is a rear plan view of an unassembled backer board.
Figure 14:
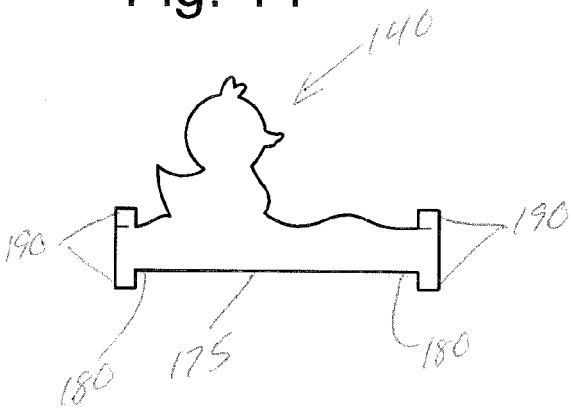
FIG. 14 is a front plan view of a decorative element.
Figure 15:
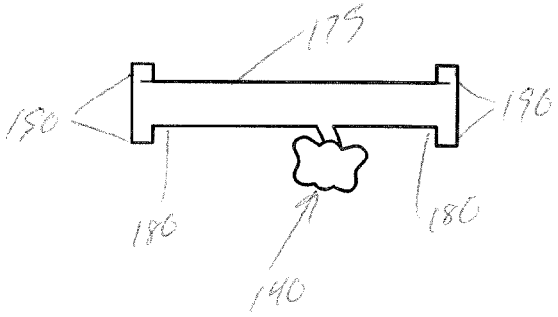
FIG. 15 is a front plan view of a decorative element.
Figure 16:
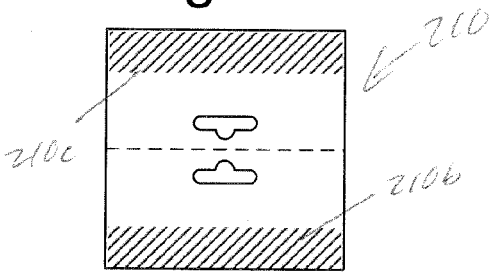
FIG. 16 is a plan view of outside surfaces of a hang tag.
Figure 17:
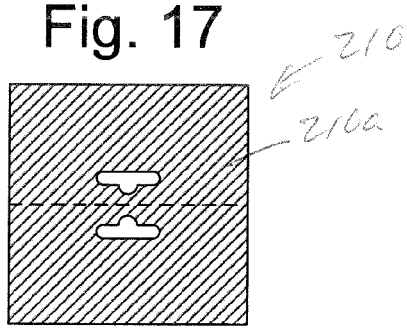
FIG. 17 is a plan view of inside surfaces of a hang tag.

The backer board 105 includes a pocket 200 therein that opens at the top margin of the backer board 105. As shown in FIGS. 12 and 13, the backer board 105 may comprise two backer panels 106 and 107 in order to form the pocket 200 therebetween. A first or front backer panel 106 includes adhesive 105*b* to contact and adhere the front surface 105*d* of the front backer panel 106 to the tabs 125*a* at locations 125*b*, and also centrally disposed adhesive 150*c* to contact and adhere the front surface 105*d* of the front backer panel 106 to the rear surface of rear panel 153. The rear surface 105*e* of the front backer panel 106 bears adhesive 105*f* so that when the rear backer panel 107 is pivoted upward along fold line 108 the rear backer panel 107 contacts and adheres to rear surface 105*e* via adhesive 105*f*. Adhesive is omitted from a space 105*g* sized to accept a gift card on the rear surface 105*e* so that when panel 106 and panel 107 are attached or adhered to one another, a pocket 200 is formed corresponding to such space 105*g* for receiving a gift card. A thumb notch 205 may be provided to assist with removal of a gift card (not shown) from the pocket 200. FIGS. 16 and 17 show views of a hang tag 210 that may be attached to the rear surface of the backer board 105 so that the holder 100 may be hung upon the peg of a display stand at a point of sale. The hang tag 210 may include adhesive 210*a* on inner surfaces as shown in FIG. 17 for adhering the hang tag subpanels to one another. A first adhesive portion 210*b* on the outer surface of the hang tag 210 is used to attach the hang tag to the rear surface of the backer board 105. A second adhesive portion 210*c* may be used to attach the holder 100 to a polybag or other substrate.

Note that drawings are not to scale or to relative scale but are representative of aspects of one or more embodiments of the present invention.

Having thus described the invention, what is claimed as new and desired to be secured by Letters Patent is:

1. A gift card holder comprising:

a backer board supporting a bellowed frame, said frame including a front panel surrounding an aperture and first and second pleated sides extending from said front panel at opposing ends thereof to attach to a front surface of said backer board, said pleated sides causing said frame to extend further from said backer board as said pleated sides unfold, or to retract closer to said backer board as said pleated sides fold, one or more images displayed within said holder and in general alignment with said aperture, a first pleated flap within said holder, and an opposing second pleated flap within said holder, a pull tab extending laterally outward from said first pleated flap and through a first pull tab aperture within said first pleated side, a pull tab extending laterally outward from said second pleated flap and through a second pull tab aperture within a second of said pleated sides.

2. The holder of claim 1 wherein said backer board includes a pocket for receiving and holding a gift card therein.

* * * * *